US010377050B2

(12) United States Patent
Zuidervaart et al.

(10) Patent No.: US 10,377,050 B2
(45) Date of Patent: Aug. 13, 2019

(54) MANUFACTURING METHOD FOR A STATIONARY BLADE AND STATIONARY BLADE

(71) Applicant: KONINKLIJKE PHILIPS N.V., Eindhoven (NL)

(72) Inventors: Jasper Zuidervaart, Eindhoven (NL); Martinus Bernardus Stapelbroek, Eindhoven (NL); Albert Jan Aitink, Eindhoven (NL); Onno Hoitinga, Eindhoven (NL); Folkert Vrijburg, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 15/573,500

(22) PCT Filed: May 18, 2016

(86) PCT No.: PCT/EP2016/061056

§ 371 (c)(1),
(2) Date: Nov. 13, 2017

(87) PCT Pub. No.: WO2016/184874

PCT Pub. Date: Nov. 24, 2016

(65) Prior Publication Data

US 2018/0104834 A1 Apr. 19, 2018

(30) Foreign Application Priority Data

May 19, 2015 (EP) ..... 15168132

(51) Int. Cl.
*B26B 19/38* (2006.01)

(52) U.S. Cl.
CPC ..... *B26B 19/3893* (2013.01); *B26B 19/3846* (2013.01); *B26B 19/384* (2013.01)

(58) Field of Classification Search
CPC . B26B 19/3893; B26B 19/384; B26B 19/063; B26B 19/20; B26B 19/06
(Continued)

(56) References Cited

U.S. PATENT DOCUMENTS 2,151,965 A * 3/1939 Hanley ..... B26B 19/042 30/346.51
4,951,394 A * 8/1990 Meijer ..... B26B 19/06 30/223
(Continued)

FOREIGN PATENT DOCUMENTS

CH 229244 A 10/1943
DE 102013107228 B3 4/2014
(Continued)

OTHER PUBLICATIONS http://inspectiontutorial.blogspot.in/2009/08/welding-terminology.html.

*Primary Examiner* — Ghassem Alie

(57) ABSTRACT

The present disclosure relates to a method of forming a sheet-metal based double-walled stationary blade (24) for a hair cutting appliance (10), the method comprising: providing a first pre-product layer (70), providing a second pre-product layer (72) which is separate from the first pre-product layer (70), providing a guide slot (44) for a cutter (26), and bonding the first pre-product layer (70) and the second pre-product layer (72) to one another such that the pre-product layers (70, 72) are arranged to jointly receive a to-be-mounted cutter (26), wherein the first pre-product layer (70) and the second pre-product layer (72), in the bonded state, are at least partially offset from one another to provide a defined mating clearance fit for the to-be-mounted cutter (26), wherein the pre-product layers (70, 72) are bonded to one another at their longitudinal ends such that stationary blade teeth (54) are partially formed by the first
(Continued)

pre-product layer (70) and partially formed by the second pre-product layer (72), and wherein tips (56) of the stationary blade teeth (54) are arranged adjacent to a transition zone (84) between the pre-product layers (70, 72). The present disclosure further relates to a cutting appliance and to a blade set (22) for such an appliance.

17 Claims, 8 Drawing Sheets

(58) Field of Classification Search
USPC ..... 76/101.1; 30/208, 224, 233.5, 223, 30/346.51, 43, 43.91
See application file for complete search history.

(56) References Cited

U.S. PATENT DOCUMENTS

| | | | | |
|---|---|---|---|---|
| 5,502,292 | A | 3/1996 | Pernicka | |
| 2011/0119929 | A1 | 5/2011 | Lau | |
| 2016/0229072 | A1* | 8/2016 | Stapelbroek | B26B 19/06 |

FOREIGN PATENT DOCUMENTS

| | | | |
|---|---|---|---|
| EP | 2857155 | A1 | 4/2015 |
| JP | 2005324235 | A | 11/2005 |
| JP | 2006334641 | A | 12/2006 |
| WO | 2013150412 | A1 | 10/2013 |
| WO | 2015018989 | A1 | 2/2015 |

* cited by examiner

MANUFACTURING METHOD FOR A STATIONARY BLADE AND STATIONARY BLADE

This application is the U.S. National Phase application under 35 U.S.C. § 371 of International Application No. PCT/EP2016/061056, filed on May 18, 2016, which claims the benefit of International Application No. 15168132.7 filed on May 19, 2015. These applications are hereby incorporated by reference herein.

FIELD OF THE INVENTION

The present disclosure relates to the field of hair cutting appliances, particularly to stationary blades for blade sets for hair cutting appliances. More particularly, the present disclosure relates to manufacturing approaches for the production of stationary blades comprising a first wall and a second wall that define therebetween a guide slot, where a movable cutter blade may be at least partially encompassed and guided.

BACKGROUND OF THE INVENTION

EP 2 857 155 A1 discloses a method of manufacturing a stationary blade, and a stationary blade for a blade set of a hair cutting appliance, the stationary blade comprising a first wall portion, an intermediate wall portion, and a second wall portion, wherein the first wall portion and the second wall portion face each other, wherein the intermediate wall portion is arranged between the first wall portion and the second wall portion, wherein facing projections along the first and second wall portions are mediately connected via the intermediate wall portion at their leading edges to define a plurality of stationary blade teeth.

WO 2013/150412 A1 discloses a hair cutting appliance, a blade set for a hair cutting appliance, and a corresponding manufacturing method for a stationary blade. The manufacturing method comprises providing a first metal plate having a first laterally extending leading edge; providing a second metal plate having a second laterally extending leading edge; providing a metal strip having a lateral dimension that corresponds to that of the leading edges of the first and second metal plates, and having a longitudinal dimension that is smaller than that of the first and second metal plates; stacking the second metal plate on top of the first metal plate while arranging the metal strip in between their leading edges, such that a longitudinal cross-section of the stacked arranged arrangement is generally U-shaped; fixing the stacked arrangement by welding the strip between the first and second leading edges; and creating U-shaped teeth by machining a plurality of laterally spaced apart slots into the leading edge of the arrangement, such that said slots extend longitudinally beyond the strip.

A blade set that comprises a stationary blade that is manufactured in accordance with the above method is particularly suited for enabling both trimming and shaving operations.

For the purpose of cutting body hair, there exist basically two customarily distinguished types of electrically powered appliances: the razor, and the hair trimmer or clipper. Generally, the razor is used for shaving, i.e. slicing body hairs at the level of the skin so as to obtain a smooth skin without stubbles. The hair trimmer is typically used to sever the hairs at a chosen distance from the skin, i.e. for cutting the hairs to a desired length. The difference in application is reflected in the different structure and architectures of the cutting blade arrangement implemented on either appliance.

An electric razor typically includes a foil, i.e. an ultra-thin perforated screen, and a cutter blade that is movable along the inside of and with respect to the foil. During use, the outside of the foil is placed and pushed against the skin, such that any hairs that penetrate the foil are cut off by the cutter blade that moves with respect to the inside thereof, and fall into hollow hair collection portions inside the razor.

An electric hair trimmer, on the other hand, typically includes two cutter blades having a toothed edge, one placed on top of the other such that the respective toothed edges overlap. In operation, the cutter blades reciprocate relative to each other, cutting off any hairs that are trapped between their teeth in a scissor action. The precise level above the skin at which the hairs are cut off is normally determined by means of an additional attachable part, called a (spacer) guard or comb.

Furthermore, combined devices are known that are basically adapted to both shaving and trimming purposes. However, these devices merely include two separate and distinct cutting sections, namely a shaving section comprising a setup that matches the concept of powered razors as set out above, and a trimming section comprising a setup that, on the other hand, matches the concept of hair trimmers.

Common electric razors are not particularly suited for cutting hair to a desired variable length above the skin, i.e., for precise trimming operations. This can be explained, at least in part, by the fact that they do not include mechanisms for spacing the foil and, consequently, the cutter blade from the skin. But even if they did, e.g. by adding attachment spacer parts, such as spacing combs, the configuration of the foil, which typically involves a large number of small perforations, would diminish the efficient capture of all but the shortest and stiffest of hairs.

Similarly, common hair trimmers are not particularly suited for shaving, primarily because the separate cutter blades require a certain rigidity, and therefore thickness, to perform the scissor action without deforming. It is the minimum required blade thickness of a skin-facing blade thereof that prevents hair from being cut off close to the skin. Consequently, a user desiring to both shave and trim his/her body hair may need to purchase and apply two separate appliances.

Furthermore, combined shaving and trimming devices show several drawbacks since they basically require two cutting blade sets and respective drive mechanisms. Consequently, these devices are heavier and more susceptible to wear than standard type single-purpose hair cutting appliances, and also require costly manufacturing and assembling processes. Similarly, operating these combined devices is often experienced to be rather uncomfortable and complex. Even in case a conventional combined shaving and trimming device comprising two separate cutting sections is utilized, handling the device and switching between different operation modes may be considered as being time-consuming and not very user-friendly. Since the cutting sections are typically provided at different locations of the device, guidance accuracy (and therefore also cutting accuracy) may be reduced, as the user needs to get used to two distinct dominant holding positions during operation.

The above WO 2013/150412 A1 tackles some of these issues by providing a blade set comprising a stationary blade that houses the movable blade such that a first portion of the stationary blade is arranged at the side of the movable blade facing the skin, when used for shaving, and that a second portion of the stationary blade is arranged at the side of the movable blade facing away from the skin when in use. Furthermore, at a toothed cutting edge, the first portion and the second portion of the stationary blade are connected, thereby forming a plurality of stationary teeth that cover respective teeth of the movable blade. Consequently, the movable blade is guarded by the stationary blade.

This arrangement is advantageous insofar as the stationary blade may provide the blade set with increased strength and stiffness since the stationary blade is also present at the side of the movable blade facing away from the skin. This may generally enable a reduction of the thickness of the first portion of the stationary blade at the skin-facing side of the movable blade. Consequently, since in this way the movable blade may come closer to the skin during operation, the above blade set is well-suited for hair shaving operations. Aside from that, the blade set is also particularly suited for hair trimming operations since the configuration of the cutting edge, including respective teeth alternating with slots, also allows longer hairs to enter the slots and, consequently, to be cut off by the relative cutting motion between the movable blade and the stationary blade.

However, there is still a need for improvement in hair cutting appliances and respective blade sets. This may particularly involve manufacturing related aspects, particularly suitability for series production or mass production, and the provision of design features that are enabled by novel manufacturing and/or material approaches for the formation of blade sets, particularly of stationary blades, in accordance with the above general structural arrangement.

SUMMARY OF THE INVENTION

It is an object of the present disclosure to provide an alternative method for manufacturing a stationary blade and a blade set which are particularly suited for both shaving and trimming operations. Furthermore, a corresponding stationary blade shall be provided. In regard of the manufacturing method, it would be advantageous to provide a production method that permits the production of double-walled stationary blades that can be produced with relatively little efforts and relatively little material expenditures. Furthermore, preferably the manufacturing method enables a relatively simple design and structure of a blade set that comprises a respective stationary blade which may particularly involve the capability to receive a movable cutter in the stationary blade without the need of additional parts, such as springs, etc.

In regard of the stationary blade, it is further preferred to provide for a stationary blade, and for a hair cutting appliance that is fitted with a respective blade set that comprises a corresponding stationary blade, wherein the hair cutting appliance exhibits an improved operating performance for trimming and shaving operations while, at the same time, preferably reducing the time required for grooming operations.

In a first aspect of the present disclosure, a method of forming a sheet-metal based double-walled stationary blade for a blade set of a hair cutting appliance is presented, the stationary blade comprising a first wall and a second wall that define therebetween a guide slot arranged to receive a removable cutter, wherein the first wall and the second wall are jointly connected at a longitudinal end thereof, thereby forming stationary blade teeth that guard respective cutter teeth of the cutter, the method comprising the following steps:

providing a first pre-product layer, providing a second pre-product layer which is separate from the first pre-product layer, wherein the steps of providing the first pre-product layer and the second pre-product layer comprise providing no more than the first pre-product layer and the second pre-product layer, providing a guide slot, for a cutter, between the first pre-product layer and the second pre-product layer, and bonding the first pre-product layer and the second pre-product layer to one another such that the first pre-product layer and the second pre-product layer are arranged to jointly receive a to-be-mounted cutter, wherein the first pre-product layer and the second pre-product layer, in the bonded state, are at least partially offset from one another to provide a defined mating clearance fit for the to-be-mounted cutter, wherein a longitudinal end of the first pre-product layer and a longitudinal end the second pre-product layer are bonded to one another such that stationary blade teeth are partially formed by the first pre-product layer and partially formed by the second pre-product layer, and wherein tips of the stationary blade teeth are arranged adjacent to a transition zone between the first pre-product layer and the second pre-product layer.

This aspect is based on the insight that, in contrast to known manufacturing methods as disclosed in the above-referenced WO 2013/150412 A1, the double-walled configuration of the stationary blade may be achieved also on the basis of only two distinct and separate pre-product layers, particularly two sheet metal-based pre-product layers. Conventional manufacturing methods either require to combine three distinct layers, as disclosed in WO 2013/150412 A1, or are based on a bending operation that is applied to a single sheet-metal layer, wherein two legs of the sheet-metal layer are bent by about 180° to form a U-shaped section based on only a single layer.

In accordance with the above aspect, only a first layer and a second layer are necessary to form the desired guarding or embracing geometry of the stationary blade. To this end, the formation of the guide slot is also required which is crucial for receiving the movable cutter in a defined fashion so as to ensure the cutting performance.

It is particularly preferred that the teeth of the stationary blade comprise a U-shaped cross-section which is defined by the first pre-product layer, the second pre-product layer and, if at all, the transition zone or bonding zone therebetween. In other words, no third or intermediate sheet-metal based pre-product layer is required and present in the finished stationary blade.

In accordance with at least some exemplary embodiments, it is preferred that the guide slot is not processed in a conventional fashion, for instance by common material-removing operations. Therefore, it is preferred that the guide slot is not processed by standard conventional (material removing) machining, particularly grinding or milling. Further, it is preferred that the guide slot is not formed by a cutting or stamping operation.

In accordance with alternative exemplary embodiments, the guide slot may be processed using material-removing machining operations, such as milling, grinding, chemical milling (etching), electrochemical machining (ECM), or electrical discharge machining (EDM). Also in these embodiments, only two layers are required for forming the stationary blade.

The guide slot as such defines a shell for the to-be-received cutter. As a consequence, the guide slot may contribute to a predefined or pre-set vertical and longitudinal orientation of the cutter. Generally, the cutter is slidingly (or: slidably) received in the guide slot wherein a relative lateral motion between the cutter and the stationary blade is enabled.

In accordance with the above method, a beneficial and cost-saving alternative manufacturing approach is provided which may result in a sheet-metal based double-walled stationary blade. In such a stationary blade, both a first wall—which may be referred to as skin-facing wall—and a second wall—which may be referred to as wall facing away from the skin—may be present. Since both the first wall and the second wall are connected at their longitudinal ends, where toothed leading edges are formed, a considerably stiff arrangement may be provided. This may have the advantage that the first wall may be particularly thin so as to enable cutting off or chopping hairs very close to the skin, preferably at the level of the skin. Consequently, the shaving performance may be improved. The overall rigidity or strength of the stationary blade is backed by the second wall that is provided at the side of the cutter that is generally facing away from the skin, when the blade set is in operation. As a consequence, the second wall may be selected to be thicker than the first wall. This basically has no adverse effect on the shaving performance but provides the blade set with a considerable stiffness.

In one exemplary embodiment, the method further comprises:

processing a toothed leading edge at the stationary blade, including forming a series of stationary blade teeth, wherein a respective stationary blade tooth comprises a first leg defined by the first pre-product layer, and a second leg defined by the second pre-product layer, and wherein a tip of the stationary blade tooth is defined by the transition zone between the first pre-product layer and the second pre-product layer.

The step of processing the toothed leading edge may take place subsequently to the step of bonding first pre-product layer and the second pre-product layer. However, in the alternative, the step of processing the toothed leading edge may also take place prior to the bonding step. Furthermore, as a further alternative, the step of processing the toothed leading edge may comprise several sub-steps some of which take place prior to the bonding step and some of which may take place subsequently to the bonding step.

Processing the toothed leading edge may generally involve material removing processes, such as cutting, stamping, machining, grinding, milling, etc. Furthermore, electrochemical processes for material removing may be utilized, for instance electrochemical machining (ECM) or electrochemical etching.

Preferably, the step of processing the toothed leading edge involves processing a first toothed leading edge and a second toothed leading edge at the stationary blade wherein the first toothed leading edge and the second toothed leading edge are arranged at opposite longitudinal ends of the stationary blade. Generally, the at least one toothed leading edge extends in the lateral direction and comprises a laterally arranged series of teeth.

In a further exemplary embodiment of the method, the steps of providing the first pre-product layer and the second pre-product layer comprise providing no more than the first pre-product layer and the second pre-product layer, wherein the stationary blade, in a bonded state, consists of the first pre-product layer, the second pre-product layer, and the transition zone therebetween. This may particularly apply to any metal component of the stationary blade. In other words, the first wall, the second wall and any intermediate zone between the first wall and the second wall at the tips of the teeth is preferably composed of no more than the first pre-product layer and the second pre-product layer, and, if any, the transition zone or bonding zone therebetween.

It goes without saying that at least in some embodiments, further components may be attached to a sheet-metal based main structure of the stationary blade. This may particularly involve plastic components that are molded or otherwise attached to the metal component. Plastic components may for instance involve snap-on mounting elements, etc. However, in accordance with at least some exemplary embodiment as disclosed herein, any component of the stationary blade which is involved in the cutting operation and which particularly directly encircles or embraces the cutter is preferably made from metal material and based on sheet metal material. Those components shall consist of no more than the first pre-product layer, the second pre-product layer and, if any, any material in a bonding zone or transition zone therebetween.

In other words, the double-walled stationary blade, at least in some exemplary embodiments, may be referred to as a two-layer based stationary blade, particularly a sheet metal layer based stationary blade. In conventional stationary blade manufacturing approaches, either a bending operation is required which defines the toothed leading edge, or a stack of at least three layers of sheet metal material is required. It is therefore beneficial to provide an arrangement that consists of no more than the first pre-product layer and the second pre-product layer which may be bonded to one another and which may further act as a basis from which also the guide slot may be obtained. It is further worth mentioning in this respect that the guide slot is particularly arranged to receive a basically flat or planar cutter, particularly a sheet-metal based movable cutter blade. Therefore, the guide slot preferably provides, at least sectionally, basically parallel guide surfaces that are offset from one another and that define therebetween a desired gap (vertical gap) for receiving the cutter.

In yet another embodiment of the method, the step of bonding the first pre-product layer and the second pre-product layer to one another includes directly bonding the first pre-product layer and a second pre-product layer to one another, preferably by laser welding. Generally, laser welding may be utilized to heat and soften at least one of the first pre-product layer and the second pre-product layer so as to bond both layers to one another. Further bonding approaches may be envisaged, for instance soldering, conventional welding, friction welding, etc. Preferably, a bonding material that is used for bonding the first pre-product layer and the second pre-product layer is either an inherent material of the layers themselves, or an additional but rather similar bonding material that is applied to any bonding zone between the first pre-product layer and the second pre-product layer, particularly adjacent to the tips of the to-be-formed teeth.

In yet another exemplary embodiment of the method, the step of bonding the first pre-product layer and the second pre-product layer to one another comprises depositing material at the transition zone, thereby forming tips of the stationary blade teeth that connect the first pre-product layer and the second pre-product layer to one another. The material that can be deposited is preferably similar to or basically the same as the material from which the first pre-product layer and/or the second pre-product layer are formed. By way of example, laser welding or other appropriate welding processes may be used and combined with the deposition of a welding material, particularly a softened or melted material. In this way, a welding seam or at least welding spots may be generated. Preferably, at least in some exemplary embodiments, an intermediate layer of the deposited material is generated which connects the first pre-product layer and the second pre-product layer in a defined orientation where both layers are spaced from one another in a defined fashion.

This may have the advantage that the transition zone or bonding zone which may be generated by the deposited material may form and fix the desired gap between the first pre-product layer and the second pre-product layer. Hence, the first pre-product layer and the second pre-product layer may be arranged at a designed offset from one another, wherein the deposited material may "bridge" the offset or gap and thereby form the tips of the teeth.

In yet another exemplary embodiment of the method, the step of bonding the first pre-product layer and the second pre-product layer to one another comprises melting material at the transition zone, thereby forming tips of the stationary blade teeth that connect first pre-product layer and the second pre-product layer to one another. Also with this embodiment, the first pre-product layer and the second pre-product layer may be arranged at a defined offset in a fashion spaced from one another, wherein heat may be applied to at least one of the layers so as to soften or melt material which may then be deformed so as to connect the layer with the respective opposite layer. Preferably, the material is melted or softened only at a defined spot adjacent to the longitudinal ends of the to-be-processed teeth so as to define the tips of the teeth after the bonding step.

In yet another embodiment of the method, the step of processing a guide slot between the first pre-product layer and the second pre-product layer comprises: arranging the first pre-product layer and the second pre-product layer in a defined fashion spaced from one another, such that inwardly facing surfaces of the first pre-product layer and the second pre-product layer at a top side and a bottom side of the guide slot are arranged to directly receive the cutter therebetween in a defined tight clearance fit mating fashion. To this end, a gaging tool or similar arrangements may be utilized. Consequently, the desired offset dimension $l_O$ may be achieved at high accuracy and with great reproducibility.

In yet another exemplary embodiment of the method, the first pre-product layer and the second pre-product layer are brought into direct surface contact before bonding the first pre-product layer and the second pre-product layer to one another such that the first pre-product layer and the second pre-product layer, adjacent to the tips of the stationary blade teeth, contact each other. This embodiment particularly involves a preceding formation or processing of the guide slot.

In accordance with another exemplary embodiment of the method, the step of processing a guide slot between the first pre-product layer and the second pre-product layer comprises: deforming at least one of the first pre-product layer and the second pre-product layer, thereby forming at least one depressed guide recess that is arranged to receive the cutter, and that forms at least part of the guide slot. In other words, at least one of the first pre-product layer and the second pre-product layer may be deformed so as to form the guide recess therein. This preferably does not involve a conventional material removing process, such as grinding, cutting or milling.

In an exemplary refinement of this embodiment, the guide recess at the at least one of the first pre-product layer and the second pre-product layer is formed by a deforming process which is selected from the group consisting of: cold forming, forging, precision forging, hot working, coining, precision stamping, and combinations thereof. Hence, a die or tool may be utilized which actually provides a negative form of the desired shape of the guide recess. Consequently, the die may be applied to the respective pre-product layer so as to define the recess therein. Preferably, the deforming process requires no post processing at all or almost no post processing.

The deforming process may have the further advantage that the processed pre-product layer may be further stiffened. Another advantage of the deforming process may be that the pre-product layer may be even further thinned in such a way that the respective wall portion of the finished stationary blade becomes even smaller in height.

In yet another exemplary refinement of the above embodiments, the guide recess at the at least one of the first pre-product layer and the second pre-product layer is formed by a net-shape or near-net-shape process. Consequently, no considerable post processing or post machining is required.

Generally, the guide recess that is formed by the deforming process may be basically rectangular and may comprise at least one laterally extending longitudinal guide for the cutter.

In still another exemplary embodiment, the step of processing the guide slot between the first pre-product layer and the second pre-product layer comprises: machining at least one of the first pre-product layer and the second pre-product layer in a material-removing fashion, thereby forming at least one depressed guide recess that is arranged to receive the cutter, and that forms at least part of the guide slot. To this end, the at least one depressed guide recess may be processed using material-removing machining operations, such as milling, grinding, chemical milling, electrochemical machining (ECM), or electrical discharge machining (EDM). Also in accordance with these embodiments, only two layers are required for forming the stationary blade including the guide slot.

In yet another exemplary embodiment, the method further comprises: depositing a protective coating at the tips of the stationary blade teeth, preferably dip coating the tips of the stationary blade teeth. The protective coating may for instance involve applying non-metal coating material to the tips of the stationary blade teeth. By way of example, liquid coating material may be utilized. Furthermore, also powder coating material may be applied. By coating the tips of the stationary teeth, the stationary blade may be arranged in an even further skin-friendly fashion. Consequently, skin irritations may be significantly reduced. Furthermore, due to a potential smooth, round and curved surface of the protective coating, the sliding capability of the stationary blade may be even further increased. This may facilitate shaving operations.

The protective coating may cover sharp edges at the tips which do not contribute to the cutting operation. Depending on an actual processing of the teeth of the stationary blade, and of the tips thereof, in some cases relatively sharp elements, edges and peaks are somewhat inevitable. The protective coating, particularly the dip coating, at the tips may basically "defuse" sharp elements so as to improve the skin-friendliness of the stationary blade.

In another aspect of the present disclosure, a sheet-metal based double-walled two-layer stationary blade for a blade set of a hair cutting appliance is presented, the two-layer stationary blade comprising:

a first wall defined by a first layer, particularly a first sheet metal layer, a second wall defined by a second layer, particularly a second sheet metal layer, wherein the first layer and the second layer define a two-layered arrangement, a guide slot, for a cutter, jointly defined by the first wall and the second wall, wherein at least one toothed leading edge is provided, the at least one toothed leading edge comprising a series of stationary blade teeth, and wherein a respective stationary blade tooth comprises a first leg defined by the first wall, a second leg defined by the second wall, and a tip at a transition zone between the first wall and the second wall, and wherein the first wall and the second wall are bonded to one another such that the first wall and the second wall are arranged to jointly receive a to-be-mounted cutter directly therebetween in a defined tight clearance fit mating fashion.

Preferably, the stationary blade in accordance with this aspect is produced in accordance with a manufacturing method in accordance with at least some embodiments as disclosed herein. Preferably, a first toothed leading edge and a second toothed leading edge is provided that are arranged at opposite laterally extending longitudinal ends of the stationary blade. Preferably, when viewed in a plane that is perpendicular to the lateral direction, the teeth of the stationary blade comprises a U-shaped profile, wherein the first leg and the second leg define respective arms of the U, and wherein the tip at the transition zone defines a bottom of the U that connects both arms.

In accordance with at least some exemplary embodiments as disclosed herein, the at least one toothed leading edge consists of no more than the first wall defined by the first layer, the second wall defined by the second layer and, if any, a bonding material at the transition zone therebetween. In other words, preferably the toothed leading edge is formed of no more than the first wall defined by the first layer, the second wall defined by the second layer and, if any, bonding material disposed therebetween.

In accordance with an exemplary embodiment of the stationary blade, the first wall and the second wall directly contact each other at the tips of the stationary blade teeth, wherein the guide slot comprises at least one depressed guide recess that is arranged to receive the cutter, wherein the depressed guide recess is provided at an inwardly facing surface of at least one of the first wall and the second wall. Preferably, the depressed guide recess is an integrally formed deepening or depression. In other words, the depressed guide recess is preferably not machined by a respective material-removing process.

In accordance with yet another exemplary embodiment of the stationary blade, the first wall or the second wall are spaced from one another in a parallel fashion to define the guide slot, wherein the tips of the stationary blade teeth are formed by bonding material that is deposited at the transition zone between the first wall and the second wall. As a consequence, the deposited or disposed bonding material may define an offset or height dimension between the first wall and the second wall at the guide slot that ensures that the cutter may be received in the guide slot in the defined tight clearance fit mating fashion.

In yet another exemplary embodiment of the stationary blade, the stationary blade teeth are dip-coated, at least at the tips thereof.

The methods and devices disclosed herein may have similar embodiments and refinements. Furthermore, a stationary blade that is formed by any of the embodiments of the manufacturing method as disclosed herein is covered by the scope of the present disclosure. In accordance with yet another aspect of the present disclosure, a blade set that comprises a corresponding stationary blade, and a cutter mounted thereto is presented.

BRIEF DESCRIPTION OF THE DRAWINGS

These and other aspects of the invention will be apparent from and elucidated with reference to the embodiments described hereinafter. In the following drawings

DETAILED DESCRIPTION OF THE EMBODIMENTS

Figure 1:
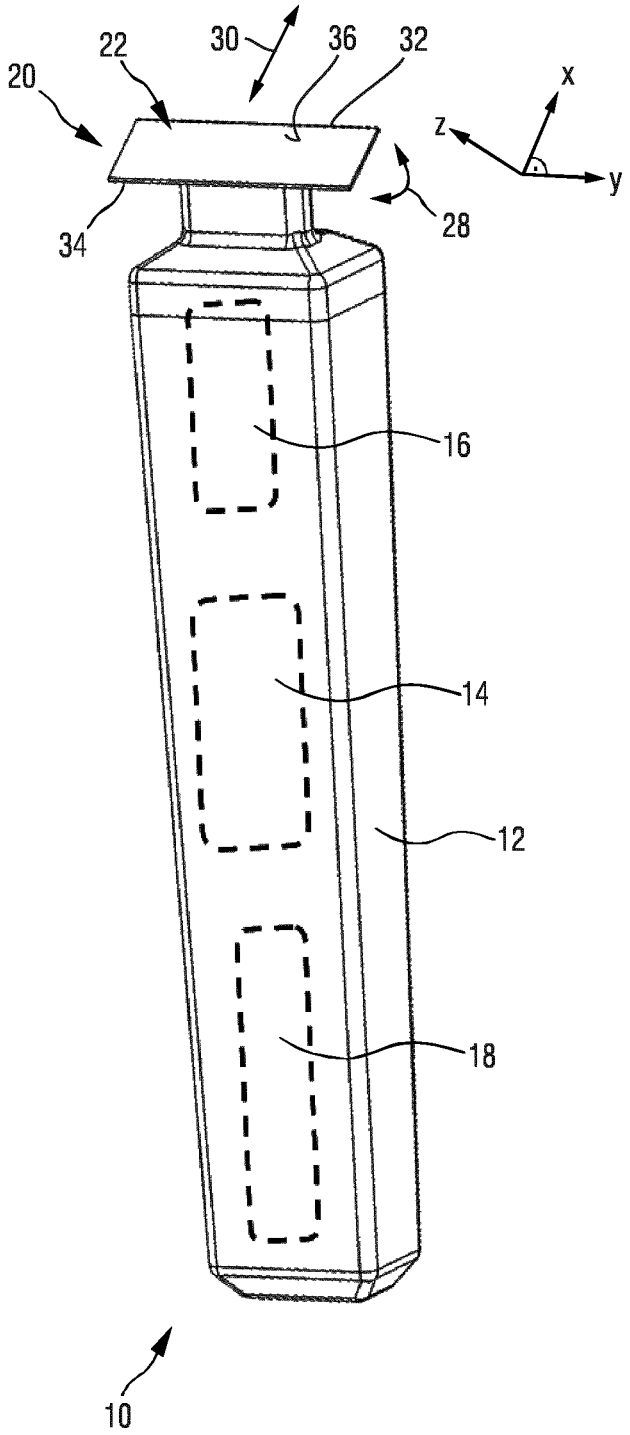
FIG. 1 shows a schematic perspective view of an exemplary arrangement of a hair cutting appliance including a cutting head implementing a blade set.

FIG. 1 schematically illustrates, in a simplified perspective view, an exemplary embodiment of the hair cutting appliance 10, particularly an electric hair cutting appliance. The hair cutting appliance 10 may comprise a housing or, more particularly, a housing portion 12, a motor indicated by a dashed block 14 in the housing portion 12, and a drive mechanism or drive train indicated by a dashed block 16 in the housing portion 12. For powering the motor 14, at least in some embodiments of the hair cutting appliance 10, an electrical battery, indicated by a dashed block 18 in the housing portion 12, may be provided, such as, for instance, a rechargeable battery, a replaceable battery, etc. However, in some embodiments, the cutting appliance 10 may be further provided with a power cable for connecting a power supply. A power supply connector may be provided in addition or in the alternative to the (internal) electric battery 18.

The hair cutting appliance 10 may further comprise a cutting head 20. At the cutting head 20, a blade set 22 may be attached to the hair cutting appliance 10. The blade set 22 may be driven by the motor 14 via the drive mechanism or drive train 16 to enable a cutting motion. The cutting motion may generally be regarded as a relative motion between a stationary blade and a movable cutter blade which will be further described and discussed hereinafter. Generally, a user may grasp, hold and manually guide cutting appliance 10 through hair in a moving direction 30 to cut hair. The cutting appliance 10 may be generally regarded as a hand-guided or hand-operated electrically powered device. Furthermore, the cutting head 20 or, more particularly, the blade set 22 can be connected to the housing portion 12 of the cutting appliance 10 in a pivotable manner, refer to the curved double-arrow indicated by reference numeral 28 in FIG. 1. In some applications, the cutting appliance 10 can be moved along skin to cut hair growing at the skin. When cutting hair closely to the skin, basically a shaving operation can be performed aiming at cutting or chopping hair at the level of the skin. However, also clipping (or trimming) operations may be envisaged, wherein the cutting head 20 comprising the blade set 22 is passed along a path at a desired distance relative to the skin.

When being guided through hair, the cutting appliance 10 including the blade set 22 is typically moved along a common moving direction which is indicated by the reference numeral 30 in FIG. 1. It is worth mentioning in this connection that, given that the hair cutting appliance 10 is typically manually guided and moved, the moving direction 30 thus not necessarily has to be construed as a precise geometric reference having a fixed definition and relation with respect to the orientation of the hair cutting appliance 10 and its cutting head 20. That is, an overall orientation of the hair cutting appliance 10 with respect to the to-be-cut hair at the skin may be construed as somewhat unsteady. However, for illustrative purposes, it may be fairly assumed that the (imaginary) moving direction 30 is parallel (or generally parallel) to a main central plane of a coordinate system which may serve in the following as a means for describing structural feature of the hair cutting appliance 10.

For ease of reference, coordinate systems are indicated in several drawings herein. By way of example, a Cartesian coordinate system X-Y-Z is indicated in FIG. 1. An axis X of the respective coordinate system extends in a generally longitudinal direction that is generally associated with length, for the purpose of this disclosure. An axis Y of the coordinate system extends in a lateral (or transverse) direction associated with width, for the purpose of this disclosure. An axis Z of the coordinate system extends in a height (or vertical) direction which may be referred to for illustrative purposes, at least in some embodiments, as a generally vertical direction. It goes without saying that an association of the coordinate system X-Y-Z to characteristic features and/or embodiment of the hair cutting appliance 10 is primarily provided for illustrative purposes and shall not be construed in a limiting way. It should be understood that those skilled in the art may readily convert and/or transfer the coordinate system provided herein when being confronted with alternative embodiments, respective figures and illustrations including alternative orientations. It is further worth mentioning that, for the purpose of the present disclosure, the coordinate system X-Y-Z is generally aligned with main directions and orientations of the cutting head 20, particularly of the blade set 22 thereof.

In accordance with one aspect of the present disclosure, manufacturing approaches are presented that aim at cost-reduced and material-saving processes for the production of stationary blades while maintaining the required function of the double-walled arrangement, i.e. particularly of the guide slot provided by the stationary blade in which the cutter is slidingly/slidably received.

Figure 2:
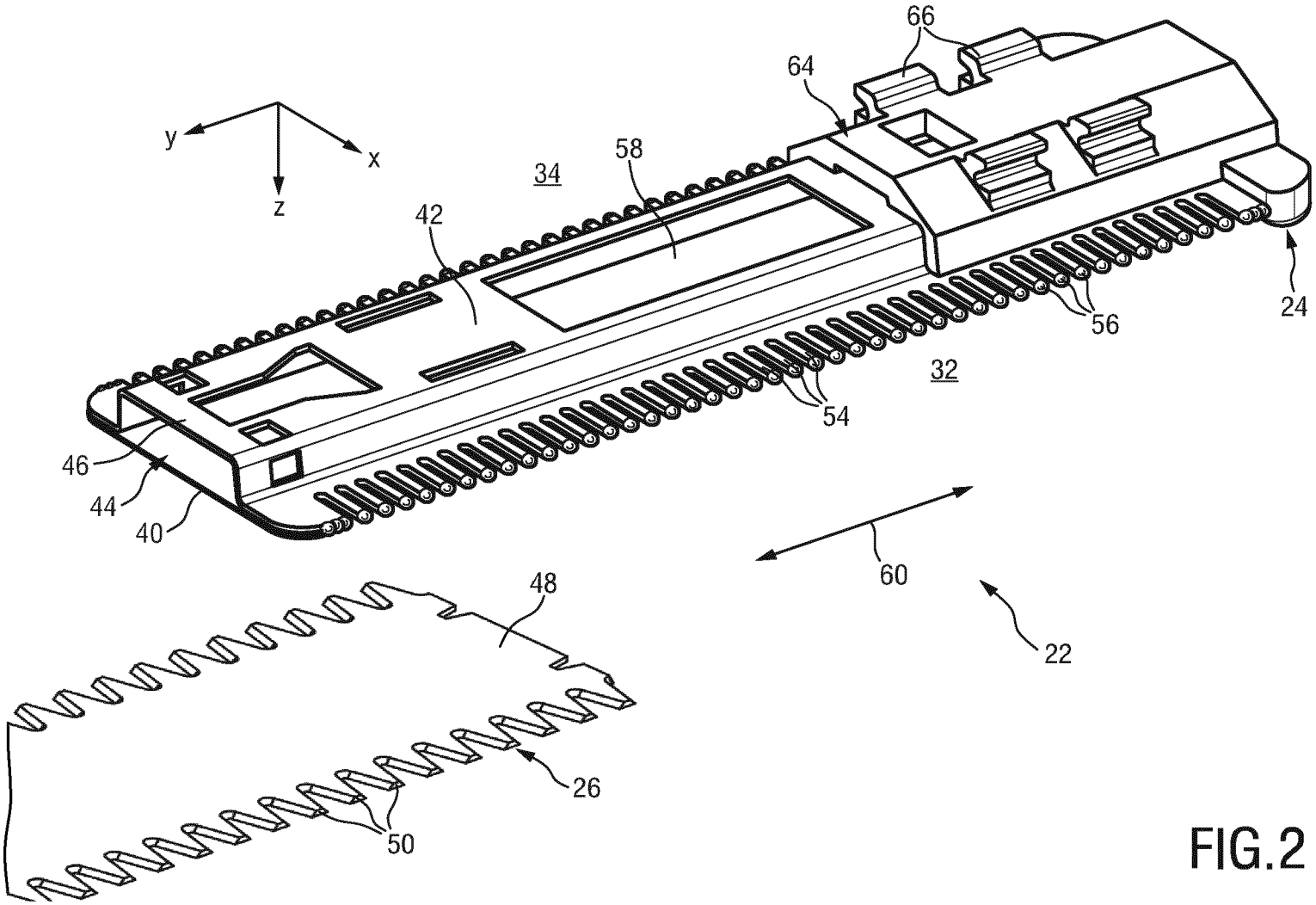
FIG. 2 shows an exploded partial perspective bottom view of a blade set comprising a stationary blade and a movable cutter blade, wherein the movable cutter blade is only partially shown, and wherein a plastic attachment to the stationary blade is partially shown in a cross-sectional state.

An arrangement of a blade set 22 that is shaped in accordance with at least some aspects of the present disclosure is shown in FIG. 2 in a perspective exploded and partially cross-sectional view. The blade set 22 consists of a stationary blade 24 and a cutter 26. Generally, the cutter 26 may be also referred to as movable cutter blade. The cutter 26 is only partially shown in FIG. 2. Further, in FIG. 2, the cutter 26 and the stationary blade 24 are shown in an exploded state, i.e. detached from one another.

As already shown in FIG. 1, preferably, the blade set 22 comprises a first leading edge 32 and a second leading edge leading edge 34 that is arranged opposite to the first leading edge 32. As can be further seen from FIG. 2, the stationary blade 24 is composed of, preferably consists of, a first wall 40 and a second wall 42. The first wall 40 may be referred to as a skin-facing wall. The second wall 42 may be referred to as a wall that is facing away from the skin when the hair cutting appliance 10 is in operation for shaving hair. The first wall 40 and the second wall 42 may be also referred to as top wall and bottom wall, respectively.

The first wall 40 and the second wall 42 are connected at the leading edges 32, 34. Between the leading edges 32, 34, the first wall 40 and the second wall 42 define a guide slot 44, particularly a generally laterally extending guide slot. The guide slot 44 is arranged for accommodating the cutter 26 in a defined fashion. This may particularly involve an appropriate guiding and positioning of the cutter 26 in the vertical direction Z. Furthermore, at least in some embodiments, the guide slot 44 may be also arranged for guiding and positioning the cutter 26 in the longitudinal direction X In one exemplary embodiment, the cutter 26 is basically composed of a sheet metal layer 48 which may be processed accordingly. By way of example, at least one series, preferably two series of movable cutter teeth 50 may be processed that provide respective cutting edges.

At the stationary blade 24, stationary blade teeth 54 may be provided at the at least one leading edge 32, 34. The teeth 54 of the stationary blade 24 are jointly defined by the first wall 40 and the second wall 42. At the respective longitudinal ends of the stationary blade, the teeth 54 form tips 56 or, in other words, run out in tips 56. The teeth 54 of the stationary blade 24 and the teeth 50 of the cutter 26 may cooperate to cut hair.

Both the first wall 40 and the second wall 42 may be obtained from sheet metal material. In the exemplary embodiment of FIG. 2, the first wall 40 is arranged as a basically planar or flat extending wall. The second wall 42 may comprise a displaced portion 46 in a central region thereof. The displaced portion may comprise a cross-section which is basically composed of a central, longitudinally extending wall and two adjacent basically vertically extending walls which connect the central, longitudinally extending wall and the teeth 54. The displaced portion 56 may be formed by appropriate bending processes. The vertically extending walls of the displaced portion 46 may be utilized to define the longitudinal position of the cutter 26. Needless to say, in some exemplary embodiments, the second wall 42 may be arranged in a basically planar fashion. Consequently, no displacement portion 46 would be provided.

In one exemplary embodiment, the stationary blade 24 comprises an engagement recess 58 which is arranged at the second wall 42, preferably at a central region of the second wall 42. Through the engagement recess 58, the drive train 16 (refer to FIG. 1) may engage the cutter 26 to set the cutter 26 in a reciprocating motion with respect to the stationary blade 24. In this way, the cutting action may be generated. A double arrow which is designated by reference numeral 60 in FIG. 2 indicates the relative reciprocating cutting motion between the stationary blade 24 and the cutter 26.

Preferably, the stationary blade 24 provides a metal shell which surrounds or embraces the guide slot 44 for the cutter 26. In other words, the metal shell is preferably composed of, or consists, of the first wall 40 and the second wall 42 and, if any, bonding material adjacent to the tips 56 that connects first wall 40 and the second wall 42.

FIG. 2 further exemplifies an embodiment of the stationary blade 24 wherein an interface part 64 is attached thereto. The interface part 64 may be provided with an arrangement of snap-on elements 66, for instance hooks, recesses, or similar mounting elements. By way of example, the interface part 64 may be arranged as an injection molded plastic interface part 64. The interface part 64 may be attached to or bonded to the second wall 42 of the stationary blade 24. To this end, an appropriate molding process may be utilized, for instance insert-molding, over-molding, outsert-molding, and such like. In accordance with the present disclosure, the interface part 64 is an add-on component which may be attached to the metal shell that is composed of the first wall 40 and the second wall 42. The interface part 64 does not necessarily form a substantial structural part of the guide slot 44.

Figure 3:
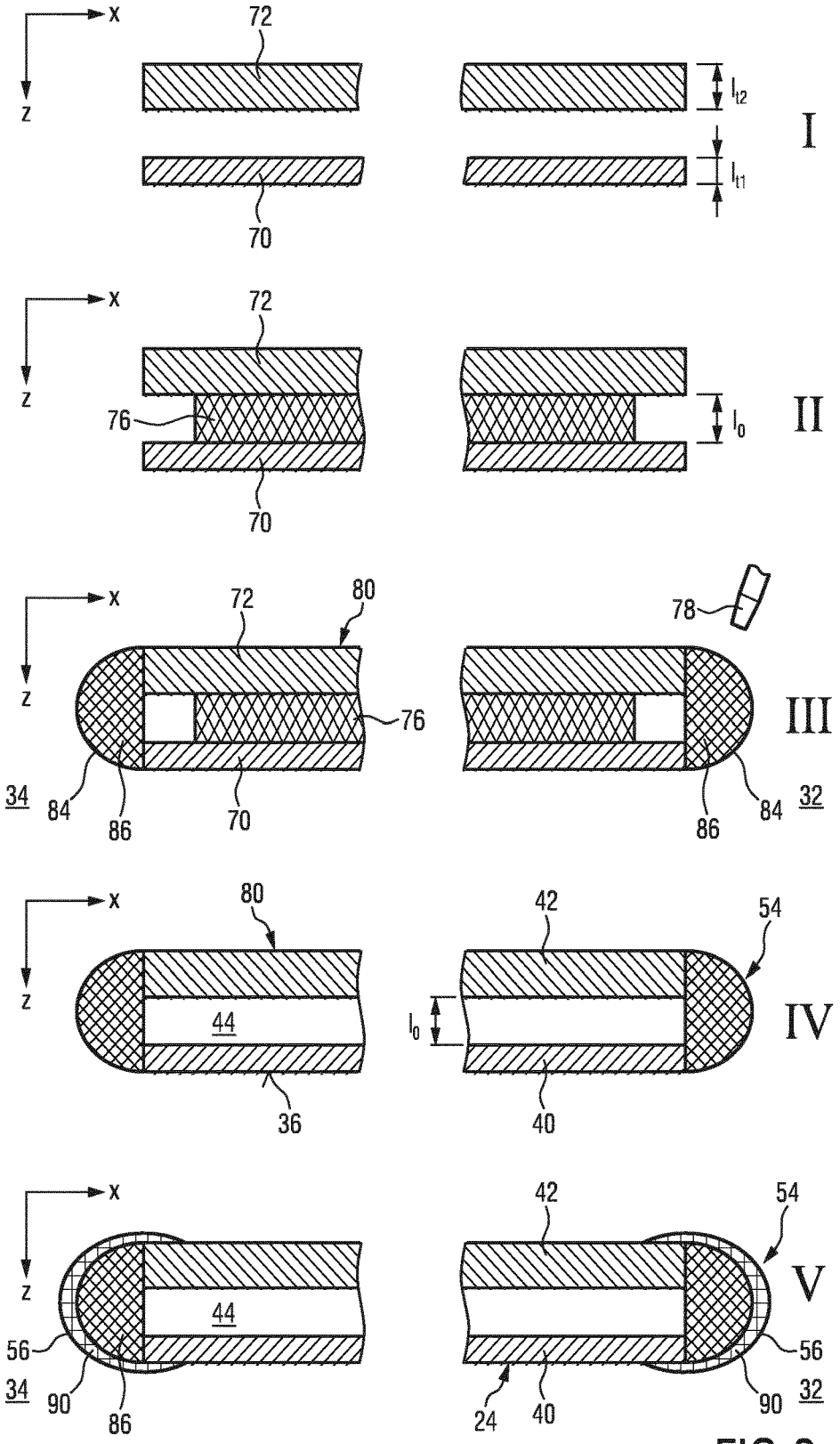
FIG. 3 illustrates in a simplified schematic lateral cross-sectional view several stages of an exemplary embodiment of a method of forming a double-walled stationary blade in accordance with the present disclosure, wherein respective components are shown in broken views.

With reference to FIG. 3, an exemplary approach to a manufacturing method for producing a stationary blade in accordance with the present disclosure is provided. FIG. 3 exemplifies several stages I to V of a manufacturing process.

In a first stage I, a first pre-product layer 70 and a second pre-product layer 72 are provided (in the following referred to as first layer 70 and second layer 72). The first layer 70 comprises a first thickness $l_{t1}$. The second layer 72 comprises a second thickness $l_{t2}$. The thickness $l_{t2}$ of the second layer 72 may be different from the thickness $l_{t1}$ of the first layer 70. Both the first layer 70 and the second layer 72 may be obtained from basically planar sheet metal material. The first layer 70 and the second layer 72 may be pre-processed, for instance to form intermediate tooth portions.

In a second stage II, the first layer 70 and a second layer 72 may be arranged at a defined relative position and/or orientation. This may involve that the first layer 70 and the second layer 72 approach one another but are spaced apart at a defined offset $l_O$. To this end, an offset gage 76 may be utilized which may be also implemented by a fixture or an appropriate tool. Therefore, the offset gage 76 indicated in FIG. 3-II shall be primarily regarded as a representative for a wide variety of position arrangement means and tools.

At a further stage III of the manufacturing process, the first layer 70 and the second layer 72 are bonded to one another using an appropriate bonding tool 78. Bonding may particularly involve welding, preferably laser welding. Preferably, the bonding tool 78 is arranged for depositing bonding material 86 at a bonding zone or transition zone 84 which connects the first layer 70 and the second layer 72. In this way, an intermediate blade 80 may be obtained. Preferably, the bonding material 86 which is disposed at the transition zone 84 is arranged to overlap or bridge the defined offset $l_O$ between the first layer 70 and the second layer 72. In this way, the first layer 70 and the second layer 72 may be bonded to one another so as to form the desired metal shell without the need of providing a third intermediate sheet metal based layer.

In a further stage IV, the offset gage 76 is removed from the intermediate blade 80. Accordingly, a guide slot 44 is provided or processed. The guide slot 44 comprises a height which exactly corresponds to the offset dimension $l_O$. Therefore, the guide slot 44 may be formed at high accuracy. Consequently, a to-be-inserted cutter 26 (refer to FIG. 2) may be received in the guide slot 44 in a defined tight clearance fit fashion for relative lateral movement with respect to the to-be-formed stationary blade 24.

Based on the first layer 70, the first wall 40 may be obtained. Based on the second layer 72, the second wall 42 may be obtained. Furthermore, the intermediate blade 80 may be further processed. This may involve a formation or further processing of the teeth 54 and the tooth tips 56 of the stationary blade 24.

In a further stage V of the manufacturing process, coating material 90 may be applied to the teeth 54, particularly to the tips 56 thereof. The coating may involve a dip coating process. The coating material 90 may protect the tips 56, and may cover sharp edges and pointed or acute contours thereof.

Eventually, the stationary blade 24 may be obtained which comprises a metal shell which is composed of the first wall 40, the second wall 42 and the bonding material 86 at the transition zone 84 therebetween that connects the first wall 40 and the second wall 42 at the leading edges 32, 34.

Figure 4:
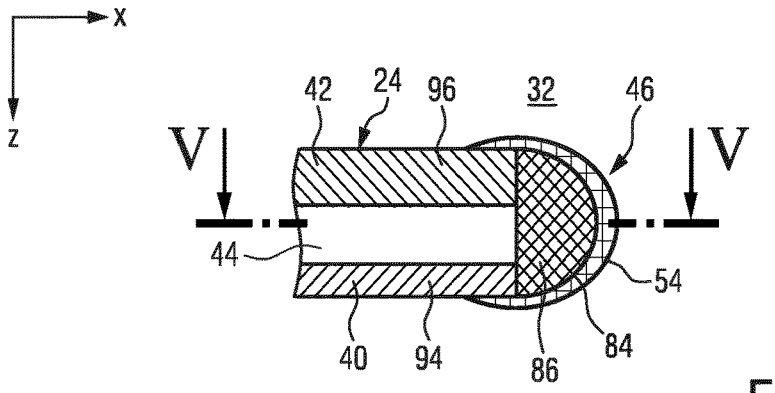
FIG. 4 shows a schematic partial cross-sectional lateral view of a stationary blade that is formed in accordance with the method as illustrated in FIG. 3.
Figure 5:
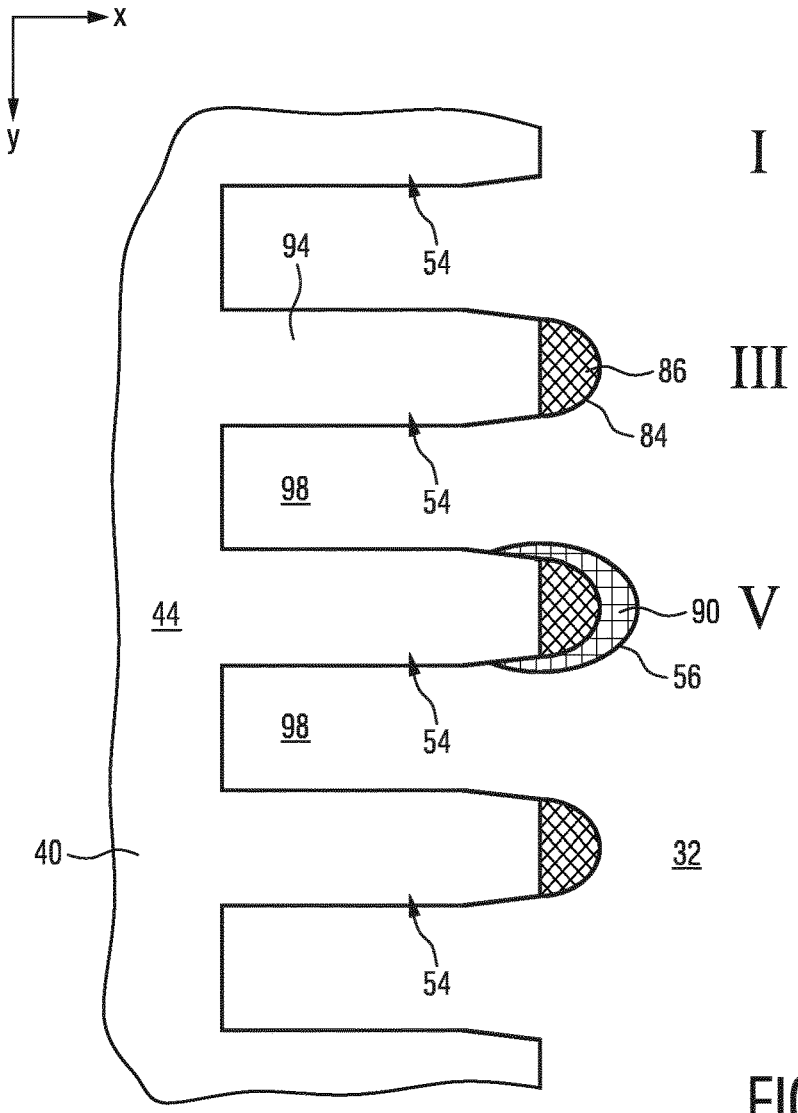
FIG. 5 shows a simplified schematic partial bottom view of the arrangement of FIG. 4, wherein a line V-V in FIG. 4 indicates a corresponding orientation of the view of FIG. 5.

Further reference in this respect is made to FIG. 4 and to FIG. 5. FIG. 4 is partial lateral cross-sectional view of an arrangement in accordance with the stage V of FIG. 3. FIG. 5 is a partial bottom view of the arrangement of FIG. 4, wherein a view orientation is indicated in FIG. 4 by a line V-V.

FIG. 5 also illustrates several stages of the teeth 54 of the stationary blade 24 in the course of the manufacturing process. Reference sign I indicates a state of a tooth 54 that corresponds to the state I of FIG. 3. Reference sign III indicates a state of a tooth 54 that corresponds to the stage III of FIG. 3. Reference sign V indicates a state of a tooth 54 that corresponds to the stage V of FIG. 3.

As can be best seen from FIG. 4, the respective teeth 54 may be composed, in the finished state, of a first leg 94 defined by the first wall 40, a second leg 96 defined by the second wall 42, and a transition zone 84 that connects the first leg 94 and the second leg 96. The first leg 94, the second leg 96 and the transition zone 84 delimit the guide slot 44. In one exemplary embodiment, a coating 90 or dip coating is applied to the teeth 54, particularly to the tips 56 thereof.

As can be further seen from FIG. 5, between adjacent teeth 54 respective tooth slots 98 may be processed. Hairs may enter the tooth slots 98 and may be cut therein in a joined cutting action of the stationary blade 24 and the corresponding cutter 26.

It should be understood that the different states I, III and V of the teeth 54 shown in FIG. 5 are primarily presented for illustrative purposes as being present at the stationary blade 24 at the same time. It goes without saying that FIG. 5 is a rather explanatory view of a stationary blade 24. Particularly in the finished state, each tooth 54 of the leading edge 32 may be in the state as indicated in FIG. 5 by reference sign V.

Generally, the formation of the legs 94, 96 (which may be also referred to as tooth stem portions) and the slots 98 that are arranged therebetween in each wall 40, 42 may take place prior to or subsequent to the bonding operation as indicated in FIG. 3 by reference sign III.

Figure 6:
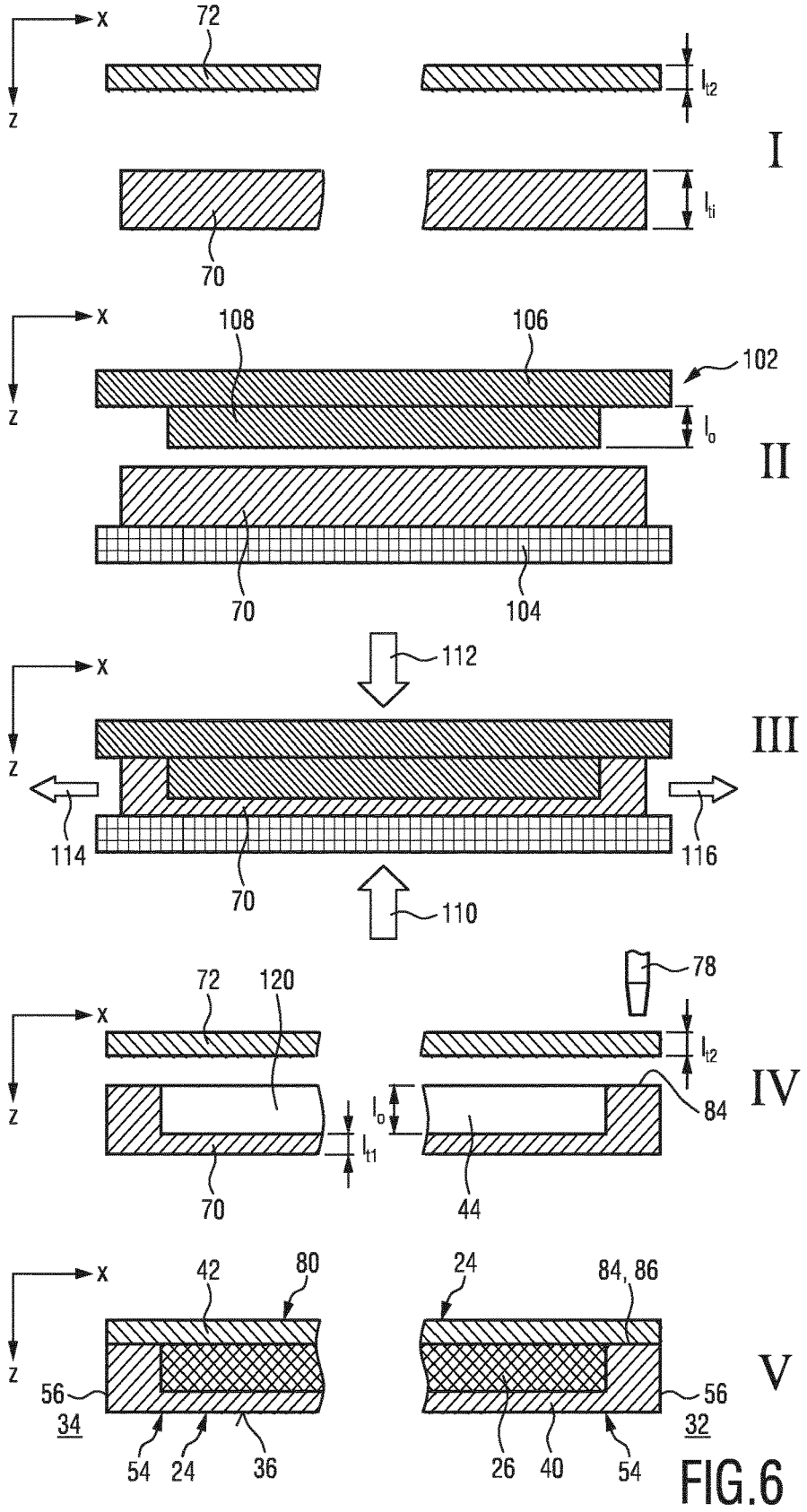
FIG. 6 illustrates in a simplified schematic lateral cross-sectional view several stages of another exemplary embodiment of a method of forming a double-walled stationary blade in accordance with the present disclosure, wherein respective components are shown in broken views.

An alternative approach to the production of a stationary blade 24 which comprises an inner metal shell which is composed of and which preferably consists of only a first wall 40 and a second wall 42 and, if any, a transition zone 84 which may involve bonding material 86, is exemplified in FIG. 6. FIG. 6 illustrates several exemplary stages I to V of the production method.

In a first stage which is indicated by reference I, a first pre-product layer 70 (in the following: first layer 70), and a second pre-product layer 72 (in the following: second layer) are provided. By way of example, the first layer 70 comprises an intermediate thickness $l_{t1}$. The second layer 72 comprises a second thickness $l_{t2}$. Both the first layer 70 and the second layer 72 may be sheet metal based layers.

In a further stage II, as an example, the first layer 70 may be processed so as to provide a desired guide slot 44. To this end, the first layer 70 may be arranged in a deforming tool 102. For instance, the deforming tool 102 may be arranged as a forging, particularly a precision forging tool. The deforming tool 102 comprises a first die 104 and a second die 106. By way of example, at the second die 106, a protrusion 108 may be provided which basically corresponds to the shape of the to-be-processed recess in the first layer 70 which shall form part of the guide slot 44 in the finished stationary blade 24. The dies 104, 106 of the deforming tool 102 may be biased and urged against the first layer 70.

The deforming process or stage is indicated by reference sign III in FIG. 6. Correspondingly, a pressing force or compression force (block arrows 110, 112) may be applied to the first layer 70. As a side effect, the first layer 70 may also undergo an elongation, as indicated in FIG. 6 by block arrows 114, 116.

The main goal of the deforming process is the formation of a depressed guide recess 120 in the first pre-product layer 70 which is indicated by a stage IV. The guide recess 120 may form at least a part of the guide slot 44 for the cutter 26. Furthermore, the deformed first layer 70 and the second layer 72 may be directly attached to one another in the stage IV. To this end, a bonding tool 78 may be utilized. The first wall 70 and a second wall 72 may be bonded to one another, for instance by an appropriate welding process, preferably a laser welding process. Also soldering processes and similar bonding processes may be envisaged. In the bonded state, the guide slot 44 comprises a vertical height which corresponds to the desired offset between the layer 70, 72 on which the first wall 40 and the second wall 42 are based. The offset $l_O$ basically corresponds to the vertical extension of the protrusion 108 of the die 106, refer also to stage II in FIG. 6.

Further, due to the deforming process, the first layer 70 is thinned adjacent to the guide slot 44. A resulting thickness or height of the first layer 70 or the first wall 40 is indicated by $l_{t1}$. As with the embodiment of FIG. 3, the second layer 72 or second wall 42 may maintain its thickness $l_{t2}$: Eventually, as shown in a stage V in FIG. 6, a cutter 26 may be received in the guide slot 44. The first layer 40 and the second layer 42 may be basically directly attached to one another. Needless to say, at the bonding zone or transition zone 84 between the first wall 40 and the second wall 42, also at least some bonding material may be disposed.

As with the embodiment of FIG. 3, prior to or subsequent to the deforming and the bonding processes, a respective machining of the teeth 54 at the leading edges 32, 34 of the stationary blade 24 may be performed. Similarly, as with the embodiment of FIG. 3, also a dip coating 90 may be applied to the teeth 54, particularly to the tips 56 thereof (not shown in FIG. 6).

Figure 7:
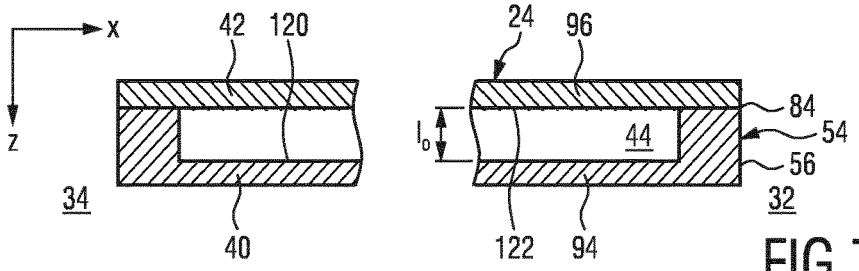
FIG. 7 shows a simplified schematic broken cross-sectional lateral view of an exemplary embodiment of a blade set formed in accordance with the method as illustrated in FIG. 6.
Figure 8:
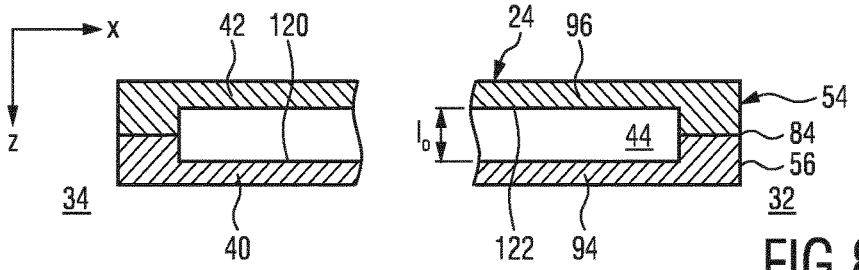
FIG. 8 shows a schematic simplified broken cross-sectional view of another exemplary embodiment of a stationary blade.
Figure 9:
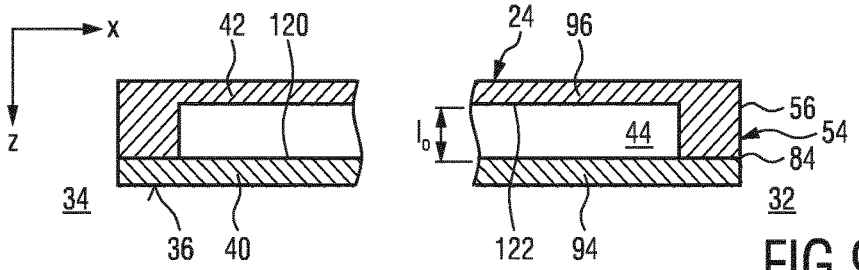
FIG. 9 shows a simplified schematic broken cross-sectional lateral view of yet another exemplary embodiment of a stationary blade.

FIG. 7, FIG. 8 and FIG. 9 illustrate broken cross-sectional lateral views of stationary blades 24 that are formed in accordance with the manufacturing method exemplified in FIG. 6. FIG. 7 illustrates an embodiment of a stationary blade 24 that basically corresponds to the configuration of the stationary blade 24 of FIG. 6. Accordingly, a depressed guide recess 120 has been processed at the first wall 40 which is obtained from a first layer 70. The teeth 54 are composed of a first leg 94 provided by the first wall 40, a second leg 96 provided by the second wall 42, and a transition zone 84 extending therebetween. Adjacent to the transition zone 84, tips 56 of the teeth 54 may be formed. Particularly between the first leg 94 and the second leg 96, a defined offset dimension $l_O$ is provided which ensures that the cutter 26 (refer to FIG. 2) may be received in a defined tight clearance fit mating fashion.

FIG. 8 illustrates a similar arrangement of a stationary blade 24 which is composed of a first wall 40 and a second wall 42 that embrace and define a guide slot 44 arranged therebetween. However, in contrast to the embodiment of FIG. 7, the guide slot 44 of FIG. 8 is partially formed by a guide recess 120 in the first wall 40 and partially formed by a guide recess 122 that is formed in the second wall 42. The guide recesses 120, 122 jointly define the guide slot 44. At the guide slot 44, the first wall 40 and the second wall 42 are at least partially arranged at an offset $l_O$ from one another. Both the guide recess 120 at the first wall 40 and the guide recess 122 at the second wall 42 may be obtained through an appropriate deforming process applied to the first layer 70 from which the first wall 40 is obtained, and the second layer 72 from which the second wall 42 is obtained, respectively. In this respect, reference is made to FIG. 6.

FIG. 9 illustrates a further alternative embodiment of a stationary blade 24 in accordance with the present disclosure. The embodiment of FIG. 9 differs from the embodiment of FIG. 7 in that the guide slot 44 is primarily provided by a guide recess 122 in the second wall 42. By contrast, the first wall 40 does not comprise a respective guide recess. The guide recess 122 can be obtained by appropriately processing or deforming the second layer 72 from which the second wall 42 is obtained. The guide recess 122 ensures that the first wall 40 and the second wall 42 are at least partially arranged at an offset $l_O$ from one another. Consequently, again the movable blade 26 may be received in the guide slot 44 in the desired tight clearance fit mating fashion. The arrangement of FIG. 9 may have the advantage that the first blade 40 which basically defines an achievable shaving closeness is not affected by the deforming process but rather the second blade 42. Hence, the first blade 40 may maintain its original thickness $l_{t1}$ which may correspond to an accurately defined thickness of the provided first layer 70.

In accordance with some exemplary alternative embodiments, any of the guide recesses 120, 122 as discussed herein may be formed by material removing, such as grinding, milling, and/or electrochemical machining.

Figure 10:
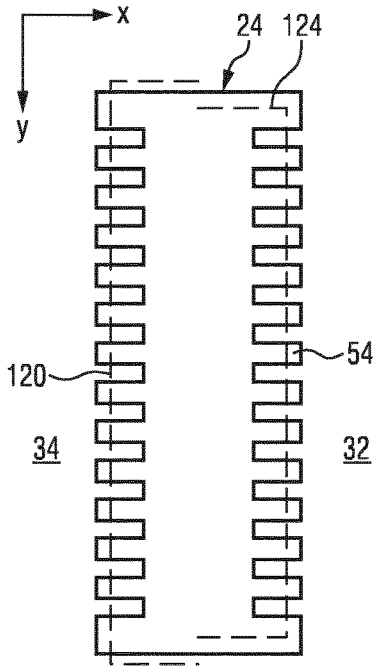
FIG. 10 shows a simplified schematic bottom view of a stationary blade comprising two toothed leading edges.

FIG. 10 illustrates a simplified schematic bottom view of a stationary blade 24 formed in accordance with the exemplary embodiment of the manufacturing method as illustrated in FIG. 6. In FIG. 10, dashed blocks 120, 124 (shown in half-views) schematically illustrate alternative arrangements of guide recesses 120, 122 in the stationary blade 24. The guide recess 120 extends through the whole lateral extension of the stationary blade 24, particularly of the first wall 40 and the second wall 42 thereof. By contrast, the guide recess 124 does not extend through the overall lateral extension of the stationary blade 24. In other words, as illustrated in FIG. 10, the guide recess 120 may be arranged as a through-hole, whereas the guide recess 124 may be arranged as an inner cavity of the stationary blade 24 which is delimited at longitudinal ends of the stationary blade 24. The through-hole arrangement of the guide recess 120 enables a lateral insertion of the cutter 26. By contrast, the inner cavity arrangement of the guide recess 124 basically requires that the cutter 26 is arranged in the guide slot 44 prior to the step of bonding the first wall 40 and the second wall 42.

Figure 11:
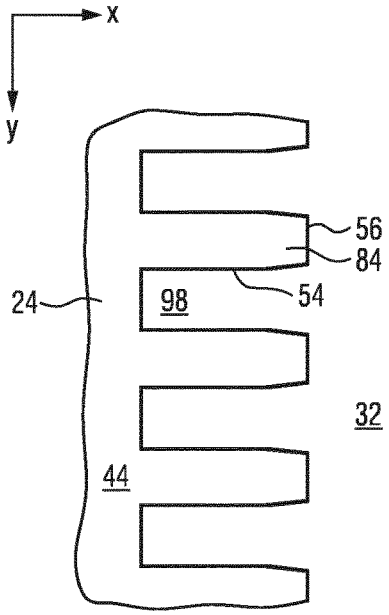
FIG. 11 shows a simplified partial detailed view of the arrangement of FIG. 10.

FIG. 11 illustrates a partial detailed bottom view of an arrangement in accordance with FIG. 10. Accordingly, the stationary blade 24 comprises a series of teeth 54, wherein respective tooth slots 98 are arranged and/or processed between neighboring teeth 54. The teeth 54 are jointly defined by the first wall 40 and the second wall 42 and connected to one another at their tips 56. At or adjacent to the tips 56, a bonding zone or transition zone 84 may be provided which also delimits the guide slot 44 in the longitudinal direction X. Again, also the embodiment as illustrated in FIGS. 6 through 11 may comprise a dip coating applied to the tips 56. Further, appropriate tooth forming and cutting edge forming measures may be applied.

Figure 12:
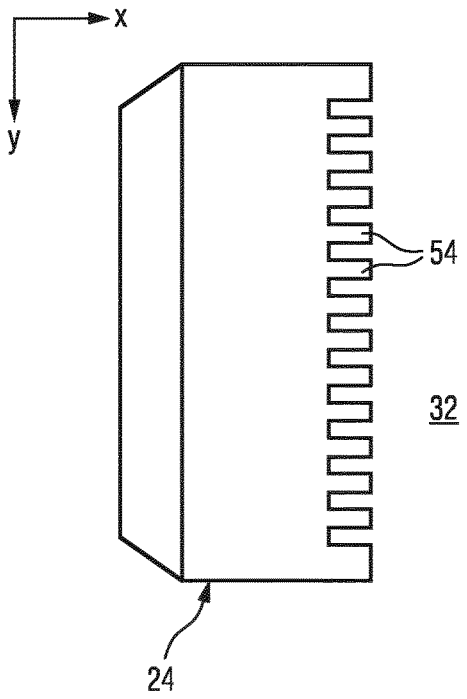
FIG. 12 shows a simplified schematic bottom view of a stationary blade comprising a single toothed leading edge.

FIG. 12 shows a simplified schematic bottom view of a stationary blade 24 in accordance with another exemplary embodiment. The stationary blade 24 is basically formed in accordance with at least some exemplary manufacturing aspects as disclosed herein. The stationary blade 24 comprises a single toothed leading edge 32. No second toothed leading edge 34 is required in accordance with this embodiment. Apart from that, the stationary blade 24 illustrated in FIG. 12 may basically correspond to the embodiments comprising two leading edges 32, 34 as shown in FIGS. 1 to 11. Hence, a first wall 40 and a second wall 42 may be provided, wherein a guide slot 44 may be provided therebetween to receive and guide a cutter 26 which may also comprise only one toothed leading edge.

Figure 13:
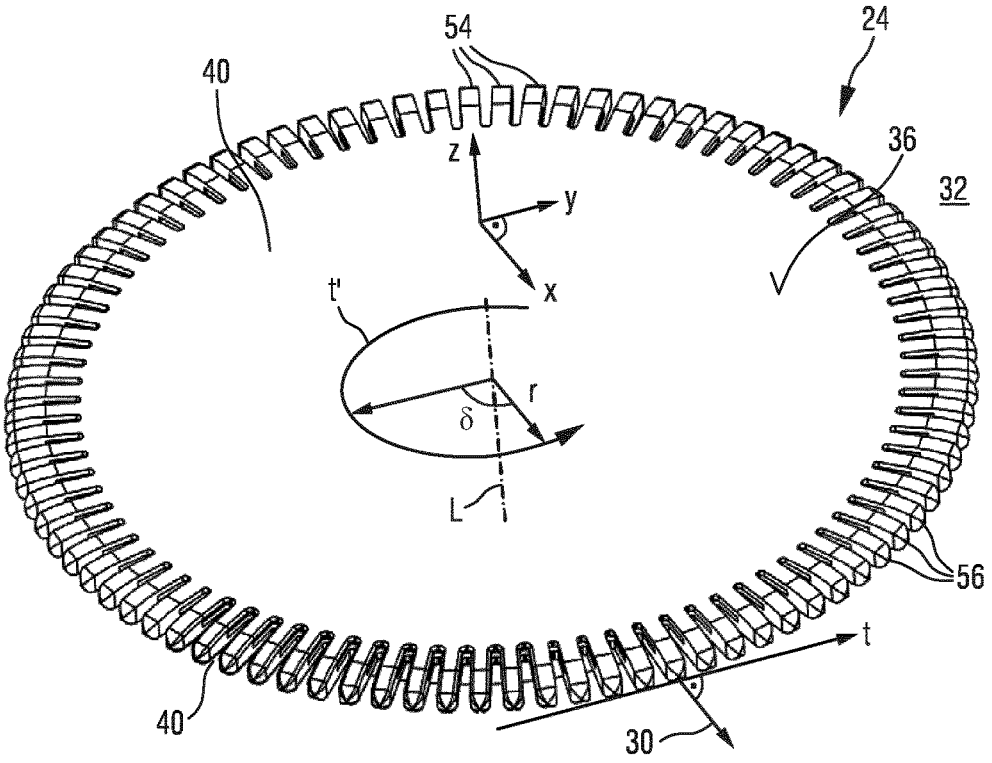
FIG. 13 shows a perspective top view of a circular arrangement of a stationary blade in accordance with another exemplary embodiment.

FIG. 13 shows a perspective top view of a circular arrangement of a stationary blade 24 a blade set 22 in accordance with another exemplary embodiment of the present disclosure. As with the embodiment of FIG. 12, also the stationary blade 24 of FIG. 13 implements only one toothed leading edge 32. As already indicated, the coordinate system X-Y-Z is primarily presented for illustrative purposes. As can be best seen in FIG. 13, the circular embodiment of the stationary blade can be best described using a polar coordinate system that is having a central axis L that basically corresponds to the vertical axis or height-indicating axis Z of the (Cartesian) coordinate system X-Y-Z. The central axis L may also be regarded as a central axis of rotation. Furthermore, a radial direction or distance r originating from the central axis L is indicated. In addition, a coordinate δ (delta) indicating an angular position may be provided depicting an angle between a reference radial direction and a present radial direction. Furthermore, a tangential direction is indicated by t in FIG. 13 which is basically perpendicular to the (imaginary) moving direction 30 and to the radial direction r of a currently observed tooth 54. In addition, a circumferential direction t' is illustrated in FIG. 13 that indicates a circumferential and/or tangential direction. In other words, the tangential direction t is a tangent line to the circumferential direction t' at a distinct point thereof that is described by an actual angle δ.

It will be readily understood by those skilled in the art that several aspects of the present disclosure described in connection with at least one of the embodiments as described above are not limited to the particular disclosed (linear) embodiment and may be therefore readily transferred and applied to other embodiments, regardless of whether they are introduced and presented in connection with a Cartesian coordinate system or a cylindrical coordinate system. A cutting operation of a blade set 22 that implements a circular stationary blade 24 and a corresponding circular cutter 26 may be effected by a relative rotational movement between the movable cutter blade 26 (not shown in FIG. 13) and the stationary blade 24. In other words, the respective cutting motion may be a one-directional rotational movement or an oscillating movement.

Also the stationary blade 24 defines a top surface 36 that faces the skin when in operation. Apart from that, respective teeth 54 may be provided that may be arranged at a single circular toothed leading edge 32. As also the circular stationary blade 24 may be arranged as a double-walled stationary blade formed in accordance with at least one aspect as disclosed herein, a first wall portion 40 and a second wall portion 42 may be present. Between the first wall portion 40 and the second wall portion 42, a guide slot 44 may be provided.

It is therefore worth mentioning in this connection that those skilled in the art understood that particularly a circular blade set 22 that implements a circular stationary blade 24 as shown in FIG. 13 having a considerably large radius may be construed, for the sake of understanding, as an approximate linearly shaped blade set, particularly when only a portion or circular segment of the circular stationary blade 24 is observed. Consequently, also the Cartesian coordinate system X, Y, Z that is used herein for defining and explaining linear embodiments may be transferred and applied to the embodiment of FIG. 13.

Figure 14:
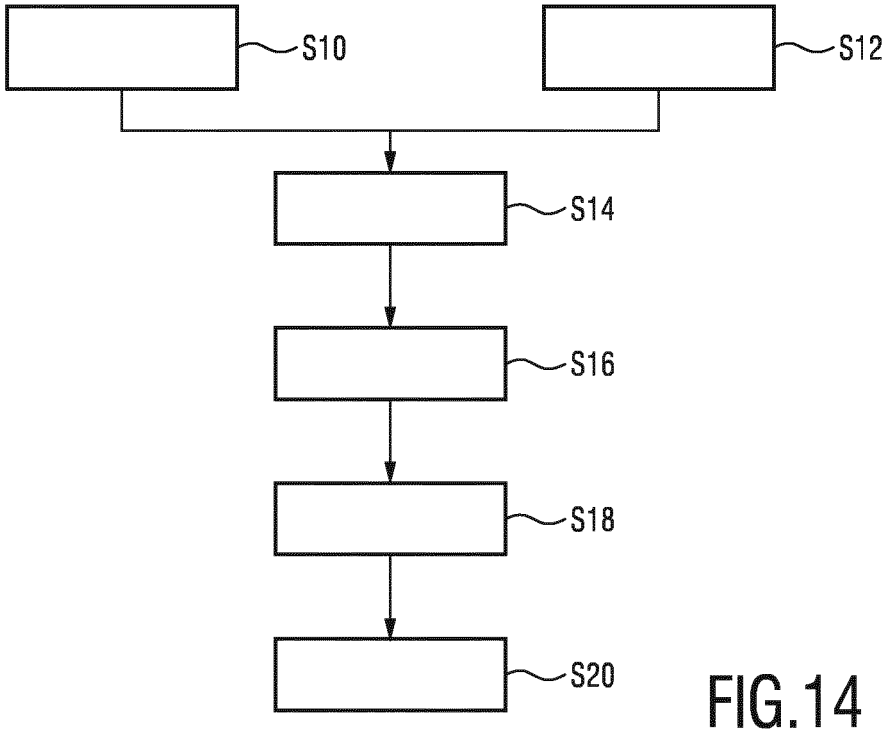
FIG. 14 shows an illustrative block diagram representing several steps of an embodiment of an exemplary manufacturing method in accordance with the present disclosure.

FIG. 14 is a block diagram schematically illustrating an exemplary manufacturing method for the production of a double-walled stationary blade for a hair cutting appliance which is composed of basically no more than a first sheet-metal layer and a second sheet-metal layer. The method comprises a step S10 which involves the provision of a first pre-product layer. Accordingly, a step S12 may be provided which comprises the provision of a second pre-product layer. At a subsequent step S14, a guide slot may be processed or provided. This may involve appropriately arranging the first pre-product layer and the second pre-product layer. This may, however, also involve processing, particularly deforming, at least one of the first pre-product layer and the second pre-product layer.

In a further step S16, a bonding operation may take place, wherein the first pre-product layer and a second pre-product layer are connected to one another, preferably at their longitudinal ends, so as to define a first laterally extending leading edge and, if any, a second laterally extending leading edge.

A further step S18 may take place which may involve processing an intermediate blade which may be obtained in the step S16. The step S18 may for instance involve tooth machining operations. Consequently, a finished state or a nearly finished state of the stationary blade may be achieved.

In an optional step S20, a coating may be applied to the teeth of the stationary plate, particularly to the tips thereof. The coating step may involve a dip coating process. The coating may cover particularly sharp edges and spots at the tips of the teeth which may increase user comfort.

As already indicated above, particularly the steps S14 and S16 which involve the provision of an appropriate guide slot and the bonding operation for connection the first pre-product layer and the second pre-product layer may involve further, alternative approaches and sub-steps.

Figure 15:
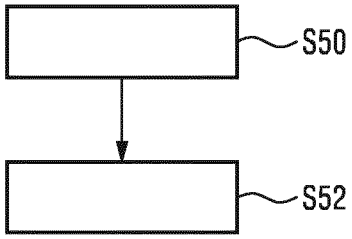
FIG. 15 shows a further illustrating block diagram representing further steps of an embodiment of an exemplary manufacturing method in accordance with the present disclosure.

By way of example, FIG. 15 shows a block diagram schematically illustrating a first exemplary embodiment of a guide slot formation process. In a first sub-step S50, the first pre-product layer and a second pre-product layer may be arranged at a desired offset from one another. To this end, for instance an offset gage or a positioning tool may be utilized. Preferably, the sub-step S50 involves that the first pre-product layer and a second pre-product layer are spaced from one another in such a way that there is no direct contact therebetween.

A further sub-step S52 may follow which involves the deposition of material at a gap between the first pre-product layer and a second pre-product layer so as to connect both pre-product layers. This may involve on the one hand, depositing bonding material so as to bridge the gap between the first pre-product layer and the second pre-product layer. On the other hand, this may involve softening at least one of the pre-product layer and the second pre-product layer so as to bring the first pre-product and the second pre-product layer into direct contact.

Figure 16:
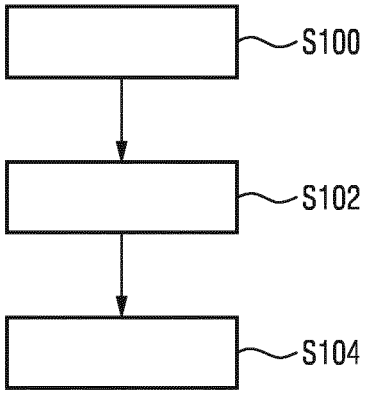
FIG. 16 shows yet another illustrative block diagram representing further steps of an embodiment of an exemplary manufacturing method in accordance with the present disclosure.

FIG. 16 shows a block diagram illustrating an alternative approach to the formation of the desired guide slot based on a two-layered arrangement. In accordance with this approach, a sub-step S100 may be provided which involves deforming at least one of the first pre-product layer and the second pre-product layer so as to form a depressed guide recess therein. The guide recess forms at least part of the guide slot.

A further sub-step S102 involves brining the first pre-product layer and a second pre-product layer into direct contact. Since at least one of the first pre-product layer and the second pre-product layer is provided with a guide recess, the guide slot may be formed therebetween.

A further sub-step S104 may follow which involves bonding the first pre-product layer and the second pre-product layer so as to fix their relative orientation. Bonding may involve welding, particularly laser welding, at the leading edges.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality. A single element or other unit may fulfill the functions of several items recited in the claims. The mere fact that certain measures are recited in mutually different dependent claims does not indicate that a combination of these measures cannot be used to advantage.

Any reference signs in the claims should not be construed as limiting the scope.

The invention claimed is:

1. A method of forming a sheet-metal based double-walled two-layer stationary blade for a blade set of a hair cutting appliance, the stationary blade comprising a first wall and a second wall that define therebetween a guide slot comprising at least one depressed guide recess arranged to slidably receive a movable cutter to enable relative lateral motion between the movable cutter and the stationary blade, wherein the first wall the second wall are jointly connected at a longitudinal end thereof, thereby forming a first and second plurality of stationary blade teeth that guard respective cutter teeth of the cutter, the stationary blade further comprising a tip defined by a transition zone between the first wall and the second wall, wherein when viewed in a plane that is perpendicular to the lateral direction, the teeth of the stationary blade comprises a U-shaped profile, wherein the first leg and second leg define respective arms of the U, and wherein the tip of the transition zone defines a bottom of the U that connects both arms, the method comprising:

providing a first pre-product layer, providing a second pre-product layer which is separate from the first pre-product layer, providing guide slot between the first pre-product layer and the second pre-product layer, wherein at least one of the first pre-product layer and the second pre-product layer is either deformed or machined in a material-removing fashion, thereby forming at least one depressed guide recess that is arranged to receive the cutter, and that forms at least part of the guide slot, and bonding the first pre-product layer and the second pre-product layer at an offset from one another to form said guide slot such that the first pre-product layer and the second pre-product layer are arranged to jointly receive the movable cutter in said guide slot, wherein said bonding comprises depositing material at a transition zone bridging said offset and thereby forming said tips of the stationary blade teeth that connect the first pre-product layer and the second pre-product layer to one another, wherein the first pre-product layer and the second pre-product layer, in the bonded state, are at least partially offset from one another to provide a defined mating clearance fit for the cutter, wherein a first and a second longitudinal end of the first pre-product layer and a respective first and a second longitudinal end the second pre-product layer are bonded to one another such that the first and second plurality of stationary blade teeth are partially formed by the first pre-product layer and partially formed by the second pre-product layer, and wherein tips of the stationary blade teeth are arranged adjacent to a transition zone between the first pre-product layer and the second pre-product layer.

2. The method as claimed in claim 1, further comprising:

processing a toothed leading edge at the stationary blade, including forming said plurality of stationary blade teeth, wherein a respective stationary blade tooth comprises a first leg defined by the first pre-product layer, and a second leg defined by the second pre-product layer, and wherein a tip of the stationary blade tooth is defined by the transition zone between the first pre-product layer and the second pre-product layer.

3. The method as claimed in claim 1, wherein the stationary blade, in the bonded state, consists of the first pre-product layer, the second pre-product layer, and a transition zone therebetween.

4. The method as claimed in claim 1, wherein the step of bonding the first pre-product layer and the second pre-product layer to one another includes directly bonding the first pre-product layer and the second pre-product layer to one another.

5. The method as claimed in claim 4, wherein said bonding comprises laser welding.

6. The method as claimed in claim 1, wherein the step of bonding the first pre-product layer and the second pre-product layer to one another comprises depositing material at the transition zone, thereby forming tips of the stationary blade teeth that connect the first pre-product layer and the second pre-product layer to one another.

7. The method as claimed in claim 1, wherein the step of bonding the first pre-product layer and the second pre-product layer to one another comprises melting material at the transition zone, thereby forming tips of the stationary blade teeth that connect the first pre-product layer and the second pre-product layer to one another.

8. The method as claimed in claim 1, wherein the first pre-product layer and the second pre-product layer are brought into direct surface contact before bonding the first pre-product layer and the second pre-product layer to one another such that the first pre-product layer and the second pre-product layer, adjacent to the tips of the stationary blade teeth, contact each other.

9. The method as claimed in claim 1, wherein the guide recess at the at least one of the first pre-product layer and the second pre-product layer is formed by a deforming process selected from the group consisting of: cold forming, forging, precision forging, hot working, coining, precision stamping, and combinations thereof.

10. The method as claimed in claim 1, further comprising depositing a protective coating at the tips of the stationary blade teeth.

11. The method as claimed in claim 1, wherein the guide recess is preferably formed by a net-shape or near net-shape process.

12. The method as claimed in claim 1, wherein the protective coating is a dip coating.

13. The method as claimed in claim 1, wherein the first wall is arranged as a planar extending wall.

14. The method as claimed in claim 1, wherein the second wall comprises a displaced portion in a central region.

15. The method as claimed in claim 1, wherein the second wall is thicker than the first wall.

16. The method as claimed in claim 1, wherein the depressed guide recess is an integrally formed depression, and wherein the depressed guide recess is provided at an inwardly facing surface of at least one of the first wall and second wall.

17. A sheet-metal based double-walled two-layer stationary blade for a blade set of a hair cutting appliance, the two-layer stationary blade comprising:

a first wall defined by a first layer, particularly a first sheet metal layer, a second wall defined by a second layer, particularly a second sheet metal layer, wherein the first layer and the second layer define a two-layered arrangement, a guide slot, for a cutter, jointly defined by the first wall and the second wall wherein at least one toothed leading edge is provided, the at least one toothed leading edge comprising a series of stationary blade teeth, and wherein a respective stationary blade tooth comprises a first leg defined by the first wall, a second leg defined by the second wall, and a tip at a transition zone between the first wall and the second wall, and wherein when viewed in a plane that is perpendicular to the lateral direction, the teeth of the stationary blade comprises a U-shaped profile, wherein the first leg and second lea define respective arms of the U, and wherein the tip of the transition zone defines a bottom of the U that connects both arms, wherein the first wall and the second wall are bonded to one another such that the first wall and the second wall are arranged to jointly receive a cutter configured to be mounted directly therebetween in a defined tight clearance fit mating fashion, wherein the first wall and the second wall are bonded together by depositing material at a transition zone bridging an offset between the first layer and the second layer thereby forming said tip of the stationary blade teeth, wherein the first wall and the second wall directly contact each other at the tips of the stationary blade teeth, and wherein the guide slot comprises at least on depressed guide recess that is arranged to receive the cutter, wherein the depressed guide recess is provided at an inwardly facing surface of the first wall or the second wall.

* * * * *